US009538291B2

(12) United States Patent
Yoon

(10) Patent No.: US 9,538,291 B2
(45) Date of Patent: Jan. 3, 2017

(54) SPEAKER

(71) Applicant: SAMSUNG ELECTRONICS CO., LTD., Suwon-si (KR)

(72) Inventor: Eui Han Yoon, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 14/798,869

(22) Filed: Jul. 14, 2015

(65) Prior Publication Data

US 2016/0088396 A1 Mar. 24, 2016

(30) Foreign Application Priority Data

Sep. 19, 2014 (KR) ..... 10-2014-0124971

(51) Int. Cl.

| | |
|---|---|
| ***H04R 9/06*** | (2006.01) |
| ***H04R 9/02*** | (2006.01) |
| ***H04R 7/18*** | (2006.01) |
| ***H04R 7/20*** | (2006.01) |
| ***H04R 9/04*** | (2006.01) |

(52) U.S. Cl.

CPC ..... *H04R 9/025* (2013.01); *H04R 7/18* (2013.01); *H04R 7/20* (2013.01); *H04R 9/045* (2013.01)

(58) Field of Classification Search

CPC ..... H04R 7/18; H04R 7/20; H04R 9/045; H04R 9/025

See application file for complete search history.

(56) References Cited

U.S. PATENT DOCUMENTS

| | | | |
|---|---|---|---|
| 5,832,096 | A | 11/1998 | Hall |
| 6,343,128 | B1 | 1/2002 | Coffin |
| 2004/0188174 | A1 | 9/2004 | Sahyoun |
| 2009/0136075 | A1 | 5/2009 | Meyer |
| 2011/0069857 | A1 | 3/2011 | Miller et al. |
| 2011/0116678 | A1 | 5/2011 | Wang |
| 2012/0163651 | A1 | 6/2012 | Zhang |

FOREIGN PATENT DOCUMENTS

| | | | |
|---|---|---|---|
| EP | 1524880 | A2 | 4/2005 |
| EP | 1524880 | A3 | 3/2010 |
| JP | 2004-304512 | A | 10/2004 |
| JP | 2010-206558 | A | 9/2010 |
| KR | 1999-0039034 | U | 11/1999 |
| KR | 10-2011-0110685 | A | 10/2011 |
| KR | 10-1086932 | B1 | 11/2011 |

OTHER PUBLICATIONS

Communication dated Oct. 28, 2015, issued by the International Searching Authority in International Patent Application No. PCT/KR2015/007401 (PCT/ISA/210).

Communication dated Dec. 8, 2015, issued by the European Patent Office in European Patent Application No. 15184334.9.

*Primary Examiner* — Tuan D Nguyen

(74) *Attorney, Agent, or Firm* — Sughrue Mion, PLLC

(57) ABSTRACT

Provided is a speaker including: a frame; a magnetic circuit unit coupled to the frame and configured to generate a magnetic force; a voice coil provided in the frame and configured to vibrate according to the magnetic force; a diaphragm configured to vibrate and produce sound in response to the vibration of the voice coil; and an edge unit that connects the diaphragm and the frame, wherein the edge unit includes a first edge provided between the diaphragm and the frame and configured to control vibration of the diaphragm; and a second edge provided under the first edge in an axial direction of the speaker.

32 Claims, 8 Drawing Sheets

SPEAKER

CROSS-REFERENCE TO RELATED APPLICATION

This application claims priority from Korean Patent Application No. 10-2014-0124971, filed on Sep. 19, 2014 in the Korean Intellectual Property Office, the disclosure of which is incorporated herein by reference in its entirety.

BACKGROUND

1. Field

Apparatuses consistent with exemplary embodiments relate to a speaker in which sound quality can be improved by suppressing division resonance.

2. Description of the Related Art

Speakers are sound output devices in which electrical signals output from an audio amplifier are converted into vibration of a vibration unit, waves of compression and rarefaction are generated in air, and sound waves are created. Speakers are classified into different types of speakers, such as magnetic speakers, dynamic speakers, condenser speakers, piezoelectric speakers, and ceramic speakers, according to their operating principles.

In the related art, a speaker includes a magnetic circuit unit including a magnet for generating magnetic flux, a yoke portion for providing a route of the magnetic flux, and a bobbin around which a voice coil is wound, a frame, and a vibrometer including a diaphragm that vibrates according to movement of the bobbin, a damper for adjusting a vibration direction of the diaphragm, and edges for fixing outer edges of the diaphragm to the frame.

In the above-described speaker, when a current is applied to the voice coil, the magnetized voice coil interacts with the magnetic flux generated in the magnets and move in a forward/back direction (i.e., between the diaphragm provided at a forward portion and the magnet provided at a back portion). Thus, the diaphragm vibrates, and sound pressure is generated.

In generating the sound pressure, the vibrometer of the speaker controls a vertical amplitude using two components including the edges and the damper.

However, when a vibrometer of a speaker according to the related art generates the vertical amplitude (a large amplitude), the vibrometer has nonlinear characteristics, and division vibration typically occurs in the vibrometer. Due to the division vibration and the nonlinear characteristics, an undesired increase in a distortion factor and distortion of frequency characteristics may occur in the vibrometer.

SUMMARY

One or more exemplary embodiments provide a speaker in which sound quality can be improved by suppressing division resonance of a diaphragm.

One or more exemplary embodiments also provide a speaker that is capable of securing linearity of a diaphragm.

One or more exemplary embodiments also provide a speaker that is capable of preventing the occurrence of an undesired increase in a distortion factor and distortion of a diaphragm.

In accordance with an aspect of an exemplary embodiment, there is provided a speaker including: a frame; a magnetic circuit unit disposed to be coupled to the frame and to generate a magnetic force; a voice coil disposed in the frame to vibrate due to the magnetic circuit unit; a diaphragm that reproduces sound while vibrating due to the voice coil; and an edge unit disposed to connect the diaphragm and the frame, wherein the edge unit may include: a first edge disposed between the diaphragm and the frame so as to control vibration of the diaphragm; and a second edge disposed at a lower side than the first edge.

The first edge may include a first contact surface formed to be connected to the diaphragm, a second contact surface formed to be connected to the frame, and a bending surface formed between the first contact surface and the second contact surface.

The bending surface may include at least one bend so as to elastically connect the diaphragm and the frame.

A separation space may be formed between the first edge and the second edge.

The second edge may include a diaphragm connection portion formed to be connected to the diaphragm, a frame connection portion formed to be connected to the frame, and a bending portion formed between the first contact surface and the second contact surface.

The diaphragm connection portion of the second edge may be connected to the first contact surface of the first edge.

The second edge may be placed so that a height of an inner circumference of the second edge is larger than a height of an outer circumference of the second edge.

The speaker may further include a damper disposed to adjust a vibration direction of the diaphragm, wherein the second edge may be disposed between the first edge and the damper.

The damper may be disposed under the diaphragm.

A cross-section of the second edge may include at least one among a circular shape, a triangular shape, a rectangular shape, a plate shape, and a wave shape.

A cross-section of the first edge may include at least one among a circular shape, a triangular shape, a rectangular shape, a plate shape, and a wave shape.

In accordance with an aspect of another exemplary embodiment, there is provided a speaker including an edge unit disposed to connect a frame and a diaphragm, wherein the edge unit may include: a first edge disposed to connect an upper portion of the diaphragm and an upper portion of the frame; and a second edge spaced apart from the first edge in a downward direction and disposed to connect an outer circumferential surface of the diaphragm and an inner circumferential surface of the frame.

The frame may include: a first flange formed on a top end of the frame so that outer edges of the first edge are connected to the first flange; and a second flange formed to be spaced apart from the first flange in a downward direction so that outer edges of the second edge are connected to the second flange.

The first flange and the second flange may have different diameters.

The first flange and the second flange may be formed to have different heights.

The first edge may include a first contact surface formed to be connected to the diaphragm, a second contact surface formed to be connected to the frame, and a bending surface formed between the first contact surface and the second contact surface.

The bending surface may include at least one bend so as to elastically connect the diaphragm and the frame.

The second edge may include a diaphragm connection portion formed to be connected to the diaphragm, a frame connection portion formed to be connected to the frame, and a bending portion formed between the first contact surface and the second contact surface.

The diaphragm connection portion of the second edge may be connected to the first contact surface of the first edge.

The second edge may be placed so that a height of the diaphragm connection portion is larger than a height of the frame connection portion.

In accordance with an aspect of yet another exemplary embodiment, there is provided a speaker including: a frame; a magnetic circuit unit disposed to be coupled to the frame and to generate a magnetic force; a voice coil disposed in the frame to vibrate due to the magnetic circuit unit; a diaphragm that reproduces sound while vibrating due to the voice coil; and an edge unit disposed to connect the diaphragm and the frame, wherein the edge unit may include: a first edge having a first contact surface connected to the diaphragm, a second contact surface connected to the frame, and a bending surface disposed to connect the first contact surface and the second contact surface; and a second edge having a diaphragm connection portion connected to the diaphragm, a frame connection portion connected to the frame, and a bending portion disposed to connect the diaphragm connection portion and the frame connection portion, and the frame connection portion of the second edge is disposed to be spaced apart from the second contact surface of the first edge.

The frame may include: a first flange formed so that the second contact surface is connected to the first flange; and a second flange formed to be spaced apart from the first flange in a downward direction so that the frame connection portion is connected to the second flange.

The first flange and the second flange may have different diameters.

The bending surface may include at least one bend so as to elastically connect the diaphragm and the frame.

The diaphragm connection portion of the second edge may come into contact with the first contact surface.

The second edge may be placed so that a height of the diaphragm connection portion is larger than a height of the frame connection portion.

In accordance with an aspect of yet another exemplary embodiment, there is provided a speaker including: a frame; a magnetic circuit unit coupled to the frame and configured to generate a magnetic force; a voice coil provided in the frame and configured to vibrate according to the magnetic force; a diaphragm configured to vibrate and produce sound in response to the vibration of the voice coil; and an edge unit that connects to the diaphragm and the frame, wherein the edge unit may include: a first edge provided between the diaphragm and the frame and configured to control vibration of the diaphragm; and a second edge provided under the first edge in an axial direction of the speaker.

The first edge may include: a first contact surface connected to the diaphragm; a second contact surface connected to the frame; and a bending surface provided between the first contact surface and the second contact surface.

The bending surface may include at least one bend that elastically connects the diaphragm and the frame.

A separation space may be provided between the first edge and the second edge.

The second edge may include: a diaphragm connection portion connected to the diaphragm; a frame connection portion connected to the frame; and a bending portion provided between the first contact surface and the second contact surface.

The diaphragm connection portion of the second edge may be connected to the first contact surface of the first edge.

An inner circumference portion of the second edge is provided closer to the magnetic circuit unit than an outer circumference portion of the second edge.

The speaker may further include a damper configured to adjust a vibration direction of the diaphragm, wherein the second edge is disposed between the first edge and the damper in the axial direction.

The damper may be provided under the diaphragm in the axial direction.

A cross-section of the second edge may include at least one among a circular shape, a triangular shape, a rectangular shape, a plate shape, and a wave shape.

A cross-section of the first edge may include at least one among a circular shape, a triangular shape, a rectangular shape, a plate shape, and a wave shape.

In accordance with an aspect of yet another exemplary embodiment, there is provided a speaker including a frame; a diaphragm and an edge unit that connects the frame and the diaphragm, wherein the edge unit includes: a first edge that connects an upper portion of the diaphragm and an upper portion of the frame; and a second edge that is spaced apart from the first edge in a downward axial direction of the speaker and connects an outer circumferential surface of the diaphragm and an inner circumferential surface of the frame.

The frame may include: a first flange provided at a top end portion of the frame and connected to outer edges of the first edge; and a second flange spaced apart from the first flange in the downward axial direction and connected to outer edges of the second edge.

A diameter of the first flange may be different from a diameter of the second flange.

A height of the first flange is different from a height of the second flange.

The first edge may include: a first contact surface connected to the diaphragm; a second contact surface connected to the frame; and a bending surface provided between the first contact surface and the second contact surface.

The bending surface may include at least one bend that elastically connects the diaphragm and the frame.

The second edge may include: a diaphragm connection portion connected to the diaphragm; a frame connection portion connected to the frame; and a bending portion provided between the first contact surface and the second contact surface.

The diaphragm connection portion of the second edge may be connected to the first contact surface of the first edge.

The diaphragm connection portion may be provided at an upward axial direction from the frame connection portion.

In accordance with an aspect of yet another exemplary embodiment, there is provided a speaker including: a frame; a magnetic circuit unit coupled to the frame and configured to generate a magnetic force; a voice coil disposed in the frame and configured to vibrate due to the magnetic force; a diaphragm configured to vibrate and generate sound due to the vibration of the voice coil; and an edge unit that connects the diaphragm and the frame, wherein the edge unit includes: a first edge including: a first contact surface connected to the diaphragm; a second contact surface connected to the frame; and a bending surface that connects the first contact surface and the second contact surface; and a second edge including: a diaphragm connection portion connected to the diaphragm; a frame connection portion connected to the frame; and a bending portion that connects the diaphragm connection portion and the frame connection portion, and wherein the frame connection portion of the second edge is disposed to be spaced apart from the second contact surface of the first edge.

The frame may include: a first flange connected to the second contact surface; and a second flange spaced apart from the first flange in a downward axial direction and connected to the frame connection portion.

A diameter of the first flange may be different from a diameter of the second flange.

The bending surface may include at least one bend that elastically connects the diaphragm and the frame.

The diaphragm connection portion of the second edge may be configured to come into contact with the first contact surface.

The diaphragm connection portion may be provided at an upward axial direction from the frame connection portion.

In accordance with an aspect of yet another exemplary embodiment, there is provided a speaker including: a frame; a magnetic circuit unit coupled to a bottom portion of the frame and configured to generate a magnetic force; a voice coil provided in the frame and configured to vibrate according to the magnetic force; a diaphragm provided inside the frame at a top portion opposite to the bottom portion in an axial direction and configured to produce sound; and an edge unit that attaches the diaphragm and the frame to each other, wherein the edge unit includes: a first edge that connects a first portion of the diaphragm and a first portion of the frame; and a second edge that connects a second portion of the diaphragm and a second portion of the frame, wherein the second portion of the frame is provided at a portion lower than the first portion of the frame.

BRIEF DESCRIPTION OF THE DRAWINGS

The above and/or other aspects will become apparent and more readily appreciated from the following description of exemplary embodiments, taken in conjunction with the accompanying drawings of which.

DETAILED DESCRIPTION

Hereinafter, exemplary embodiments of the disclosure will be described in detail with reference to the accompanying drawings.

Figure 1:
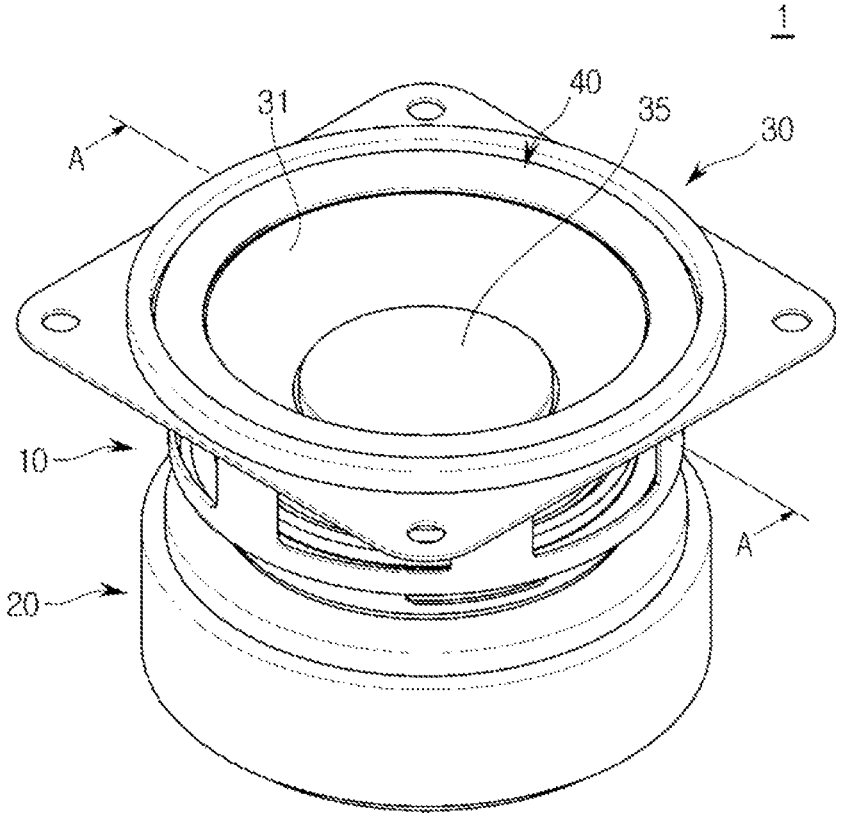
FIG. 1 is a perspective view of a speaker according to an exemplary embodiment.
Figure 2:
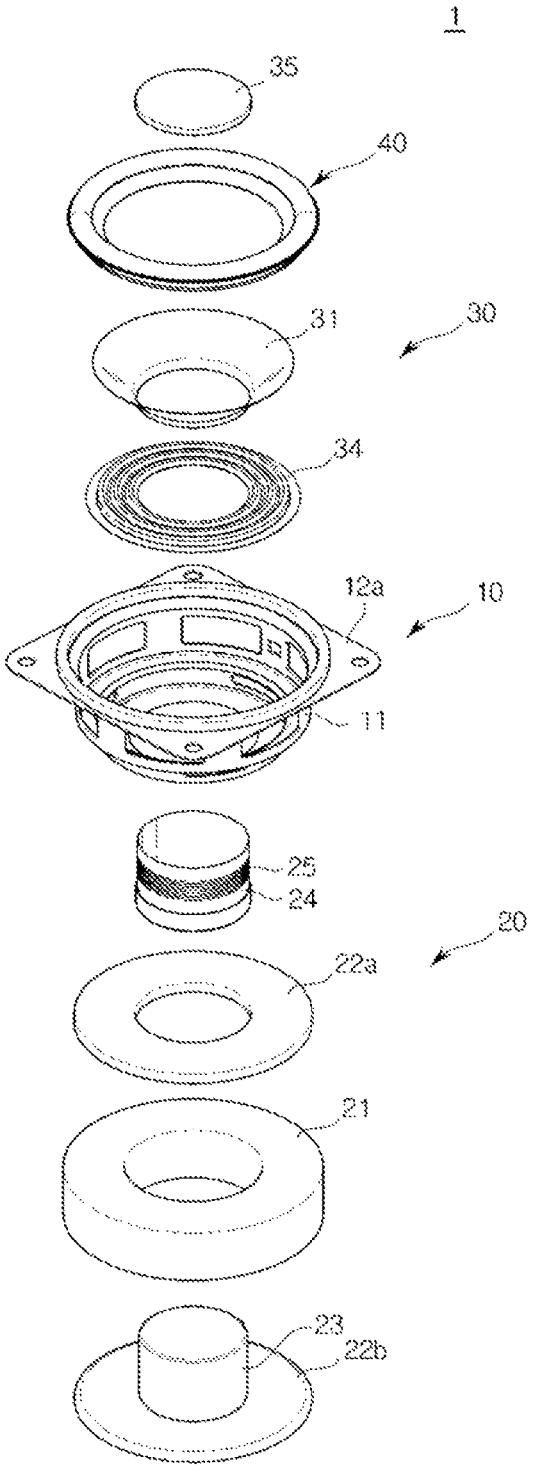
FIG. 2 is an exploded perspective view of the speaker according to an exemplary embodiment.

FIG. 1 is a perspective view of a speaker 1 according to an exemplary embodiment. FIG. 2 is an exploded perspective view of the speaker 1 according to an exemplary embodiment. As illustrated in FIGS. 1 and 2, the speaker 1 includes a frame 10 formed in a hollow tubular shape, a magnetic circuit unit 20 disposed in the frame 10, and a vibration unit 30 disposed to vibrate due to the magnetic circuit unit 20.

The frame 10 forms an exterior of the speaker 1 and includes a body 11 formed in a hollow cylindrical shape in the center of the frame 10.

Hereinafter, when describing sides and directions of components of the speaker 1 including the frame 10, a side and a direction, which are directed toward a top side of the frame 10 as shown in FIGS. 1 and 2, are referred to as a 'top side or a upper side', and a side and a direction, which are directed toward a bottom side of the frame 10, are referred to as a 'bottom side or a lower side' as shown in FIGS. 1 and 2.

The magnetic circuit unit 20 may be disposed at the lower side of the frame 10 of the speaker 1, and the vibration unit 30 may be disposed at the upper side of an inside of the frame 10 of the speaker 1.

In the exemplary embodiment, the frame 10 is formed in a cylindrical tubular shape having a hollow center. However, the exemplary embodiment is not limited thereto. The frame 10 may include a hollow funnel or conical shape formed in such a way that a diameter of a top end of the frame 10 is larger than a diameter of a bottom end of the frame 10.

Electrical signals are transmitted to the magnetic circuit unit 20 so as to generate sound in the speaker 1. The magnetic circuit unit 20 may include a magnet 21, an upper plate 22*a* and a lower plate 22*b*, which are disposed above and under the magnet 21, respectively, and a pole piece 23 disposed in the center of the magnet 21.

In the exemplary embodiment, the lower plate 22*b* and the pole piece 23 are integrally formed and the pole piece 23 protrudes from the lower plate 22*b*. However, the exemplary embodiment is not limited thereto. For example, the lower plate 22*b* and the pole piece 23 may be configured to be separately formed and coupled to each other.

The pole piece 23 may be formed to provide a route of magnetic flux generated in the magnet 21. In the exemplary embodiment, the magnet is formed in a single piece. However, the exemplary embodiment is not limited thereto and the magnet may include two or more magnets depending on the types of the speaker 1.

The magnet 21 may have a plurality of poles including one N pole and one S pole and may be magnetized in a direction from the front to the rear (i.e., from the top side to the bottom side of the speaker 1 according to FIGS. 1 and 2). Hereinafter, the front direction is a direction in which sound waves of a speaker proceed and refers to the top side of FIG. 1, and the rear direction refers to a direction toward the lower side of FIG. 1 that is an opposite direction to the front direction.

The magnet 21 may include neodymium (Nd), ferrite, or other permanent magnet materials. The magnets 21 may have a hollow ring shape.

The upper plate 22*a* and the lower plate 22*b*, which are disposed at the upper and lower sides of the magnet 21, respectively, so as to support the magnet 21, may be formed to corresponding sizes and shapes.

The upper plate 22*a* may come into contact with a fourth flange 12*d* (see FIG. 4) formed on the bottom end of the frame 10 that will be described later, and may be fixed to the fourth flange 12*d*.

The vibration unit 30 may include a voice coil 25 which vibrates while being linked to the magnetic circuit unit 20, a bobbin 24 around which the voice coil 25 is wound, a diaphragm 31 which reproduces sound while vibrating due to the voice coil 25, an edge unit 40 which connects the diaphragm 31 and the frame 10, and a damper 34 which guides a movement direction of the voice coil 25 in a vertical direction and which restricts left/right movement of the voice coil 25, and a dust cap 35 which is coupled to the bobbin 24.

The dust cap 35 is mounted on an end of the upper side of the bobbin 24 and prevents foreign substances/objects from entering into an inside of the vibration unit 30 including the bobbin 24 and the voice coil 25.

The dust cap 35 may be adhered to the inner portion of the diaphragm 31 and fixed to the diaphragm 31.

The voice coil 25 is magnetized when a current is applied to the voice coil 25, interacts with the magnetic flux generated in the magnet 21 and move in the front-to-back direction.

The diaphragm 31 performs a function of generating sound to the outside by changing pressure variation based on the movement of the voice coil 25.

In the exemplary embodiment, the diaphragm 31 has a funnel or conical shape in which a diameter of the diaphragm 31 becomes smaller toward a lower side of the diaphragm 31. However, the exemplary embodiment is not limited thereto. For example, the diaphragm 31 that is a core component for determining sound quality, a sound color and frequency characteristics of the speaker 1 may make different form or shape according to the material, mass, and structure of the diaphragm 31.

When the electrical signals are input to the speaker 1, electrical signals flow through the voice coil 25 wound around the bobbin 24. Thus, the voice coil 25 placed in a magnetic field formed by the magnet 21 makes a reciprocal motion in a vertical direction (i.e., the front-to-back direction) due to the Fleming's left hand rule.

The reciprocal motion of the voice coil 25 causes the diaphragm 31 bonded to the bobbin 24 to vibrate in the vertical direction so that air coming into contact with the diaphragm 31 may be compressed and/or expanded and thus sound waves may be generated and be output.

The edge unit 40 of the speaker 1 controls a vibration force of the vibration unit 30 transmitted to the frame 10.

Figure 3:
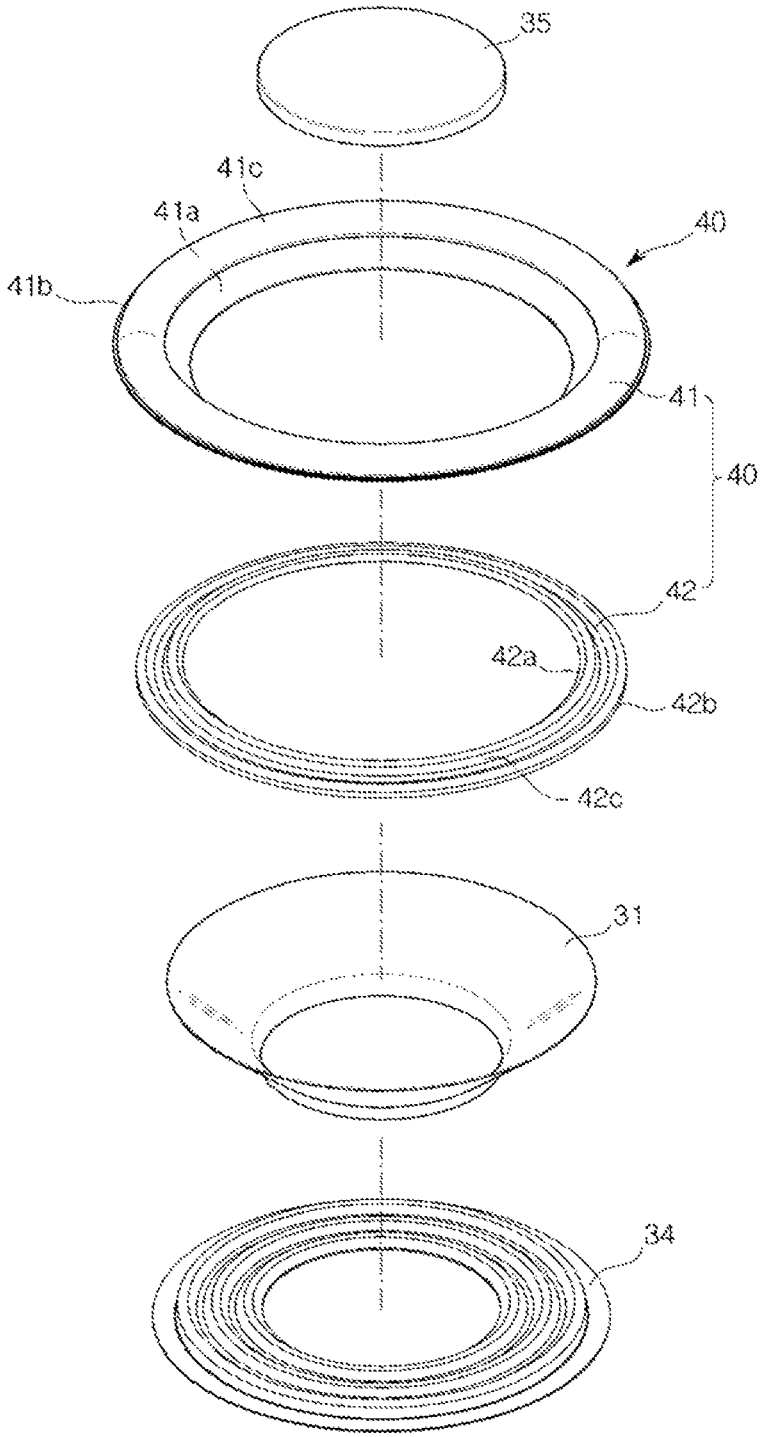
FIG. 3 is a perspective view of an edge unit of the speaker according to an exemplary embodiment.
Figure 4:
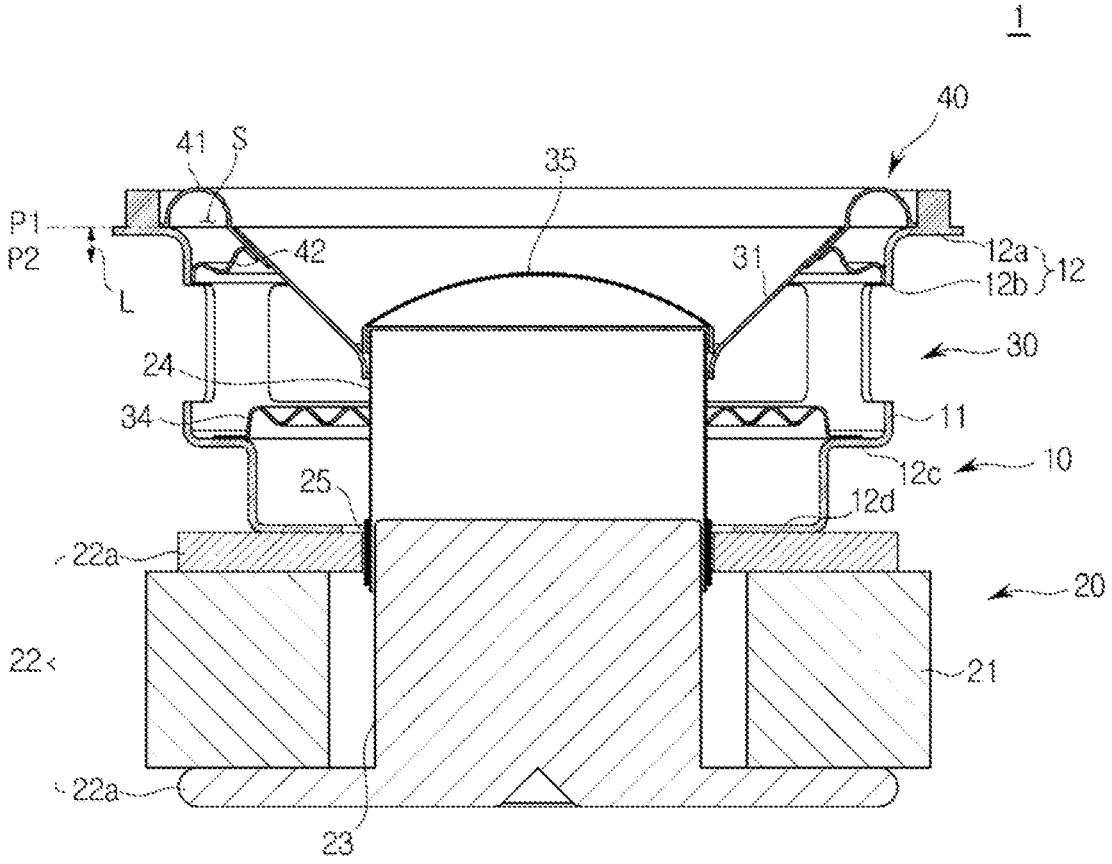
FIG. 4 is a cross-sectional view taken along line A-A of FIG. 1.

FIG. 3 is a perspective view of an edge unit of the speaker according to an exemplary embodiment. FIG. 4 is a cross-sectional view taken along line A-A of FIG. 1.

As illustrated in FIGS. 3 and 4, the edge unit 40 of the speaker 1 connects the diaphragm 31 and the frame 10.

The edge unit 40 according to the exemplary embodiment is disposed between the frame 10 and the diaphragm 31 so as to fix the diaphragm 31 to the frame 10 and simultaneously to control vibration of the diaphragm 31.

The edge unit 40 is formed to have a shape of a ring having a hollow portion formed in the center of the edge unit 40.

The edge unit 40 may be formed to have a size and/or a shape in which a center portion of the edge unit 40 is connected to upper edge portion of the diaphragm 31 as shown in FIG. 4.

The edge unit 40 may be formed of a material having a thin membrane or sheet shape. For example, the edge unit 40 may be made with a thermoplastic polyurethane (TPU) sheet, a thermoplastic olefin (TPO) sheet, an urethane foam or polypropylene (PP) sheet. However, the exemplary embodiment is not limited thereto. For example, the edge unit 40 may be formed of various materials capable of generating air pressure to create sound.

The edge unit 40 may include a first edge 41 disposed to be placed at an end of the upper side (e.g., a first position P1 shown in FIG. 4) of the diaphragm 31 and at an upper end portion of the frame 10 and a second edge 42 disposed to be placed at a lower side (e.g., a second position P2 shown in FIG. 4) than the first position P1 in which the first edge 41 is installed.

The first position P1 in which the first edge 41 is installed, may include an upper end portion of each of the diaphragm 31 and the frame 10.

The second position P2 in which the second edge 42 is installed, may be spaced a predetermined distance L apart from the first position P1 in a downward direction.

In this case, the predetermined distance L may be determined according to the size and shape of the speaker 1. Thus, the second position P2 may be placed in any undefined position between the first position P1 and the damper 34.

The first edge 41 of the edge unit 40 may include a first contact surface 41*a*, a second contact surface 41*b*, and a bending surface 41*c* formed between the first contact surface 41*a* and the second contact surface 41*b*.

The bending surface 41*c* of the first edge 41 connects the first contact surface 41*a* and the second contact surface 41*b* and to protrude upward. In this case, the bending surface 41*c* of the first edge 41 may be formed to protrude upward from a top end of the diaphragm 31. In the exemplary embodiment, the bending surface 41*c* is formed so that a cross-section of the bending surface 41*c* has a hemispherical shape. However, the exemplary embodiment is not limited thereto. For example, a cross-section of the first edge 41 may include various shapes including a triangular shape, a rectangular shape, and a wave shape.

The first contact surface 41*a* of the first edge 41 comes into contact with an outer-most portion the diaphragm 31 in a radial direction. The first contact surface 41*a* may be formed to extend from an inner circumference of the bending surface 41*c*.

The second contact surface 41*b* of the first edge 41 may be formed to extend from an outer circumference of the bending surface 41*c* outward so as to come into contact with the frame 10.

Meanwhile, the body 11 of the frame 10 may include a first flange 12*a* formed on a top end portion of the body 11, a second flange 12*b* formed to be spaced a predetermined distance apart from the first flange 12*a* in the downward direction, a third flange 12*c* formed to be spaced a predetermined distance apart from the second flange 12*b* in the downward direction, and the fourth flange 12*d* formed to be spaced apart from the third flange 12*c* in the downward direction and formed on a bottom end of the body 11 inward.

Here, the second flange 12*b* may be formed to extend from the first flange 12*a* inward, and the third flange 12*c* may be formed to extend from the second flange 12*b* inward, and the fourth flange 12*d* may be formed to extend from the third flange 12*c* inward.

Thus, the exterior of the frame 10 may be formed to have a funnel or conical shape in which a diameter of the frame 10 is increased as the frame 10 gets closer to the upper side from the lower side of the frame 10. In this case, the frame 10 may be formed to have a shape and size corresponding to those of the diaphragm 31 or the shape of size larger than the shape of the diaphragm 31 and to surround an outside of the diaphragm 31.

The second contact surface 41*b* of the first edge 41 may come into contact with the first flange 12*a* of the body 11 of the frame 10. That is, the first contact surface 41*a* of the first edge 41 is formed to be adhered to the outside of the diaphragm 31 and to be fixed thereto, and the second contact surface 41*b* of the first edge 41 is formed to be adhered to the first flange 12*a* of the frame 10 and to be fixed thereto.

To this end, the first flange 12*a* of the frame 10 may be formed to have a circular shape corresponding to the second contact surface 41*b* of the first edge 41.

The first contact surface 41*a* and the second contact surface 41*b* of the first edge 41 may be fixed to the diaphragm 31 and the frame 10, respectively, using an adhesive.

Thus, the first edge 41 may connect and fix the diaphragm 31 and the frame 10 so that, when the diaphragm 31 vibrates, the first edge 41 may perform amplitude control between the diaphragm 31 and the frame 10.

The second edge 42 is disposed at a lower portion of the first edge 41 to be spaced a predetermined distance apart from the first edge 41 and is disposed outside a lower portion of the diaphragm 31 attached to the first edge so as to connect and fix the diaphragm 31 and the frame 10.

The second edge 42 is formed to have a shape of a ring having a hollow portion formed in the center portion of the second edge 42, and is disposed so that the diaphragm 31 passes through the center of the second edge 42. The second edge 42 has a bending portion 42*c* that protrudes from the second edge 42 in the vertical direction along a circumference of the second edge 42. Here, at least one or a plurality of bending portions 42*c* of the second edge 42 may be formed.

A diaphragm connection portion 42*a* for connecting the second edge 42 and the diaphragm 31 may be formed at the inner portion of the second edge 42 in a radial direction, and a frame connection portion 42*b* for connecting the second edge 42 and the frame 10 may be formed at the outer portion of the second edge 42 in the radial direction.

The diaphragm connection portion 42*a* of the second edge 42 may come into contact with the outer surface of the diaphragm 31 and may be fixed thereto, and the frame connection portion 42*b* may come into contact with the second flange 12*b* of the frame 10 and may be fixed thereto.

In this case, the diaphragm connection portion 42*a* of the second edge 42 may be placed in a higher position than the frame connection portion 42*b* in an axial direction (i.e., front-to-back direction of the speaker 1) so that the second edge 42 has a predetermined angle with respect to the diaphragm 31.

The diaphragm connection portion 42*a* and the frame connection portion 42*b* of the second edge 42 may be fixed to the diaphragm 31 and the frame 10, respectively, using an adhesive.

In the exemplary embodiment, the second edge 42 is placed in the second position P2 that is disposed to be spaced the predetermined distance L apart from the first position P1 in the downward direction. That is, there is a separation space S provided between the first edge 41 and the second edge 42. However, the exemplary embodiment is not limited thereto. For example, the second edge 42 may be placed in a lower or higher position than the second position P2 illustrated in FIG. 4.

Thus, the second edge 42 controls vertical vibration of the diaphragm 31 at a lower side of each of the diaphragm 31 and the frame 10 when the diaphragm 31 vibrates so that abnormal resonance with respect to the vertical movement of the diaphragm 31 can be prevented from occurring.

Figure 5:
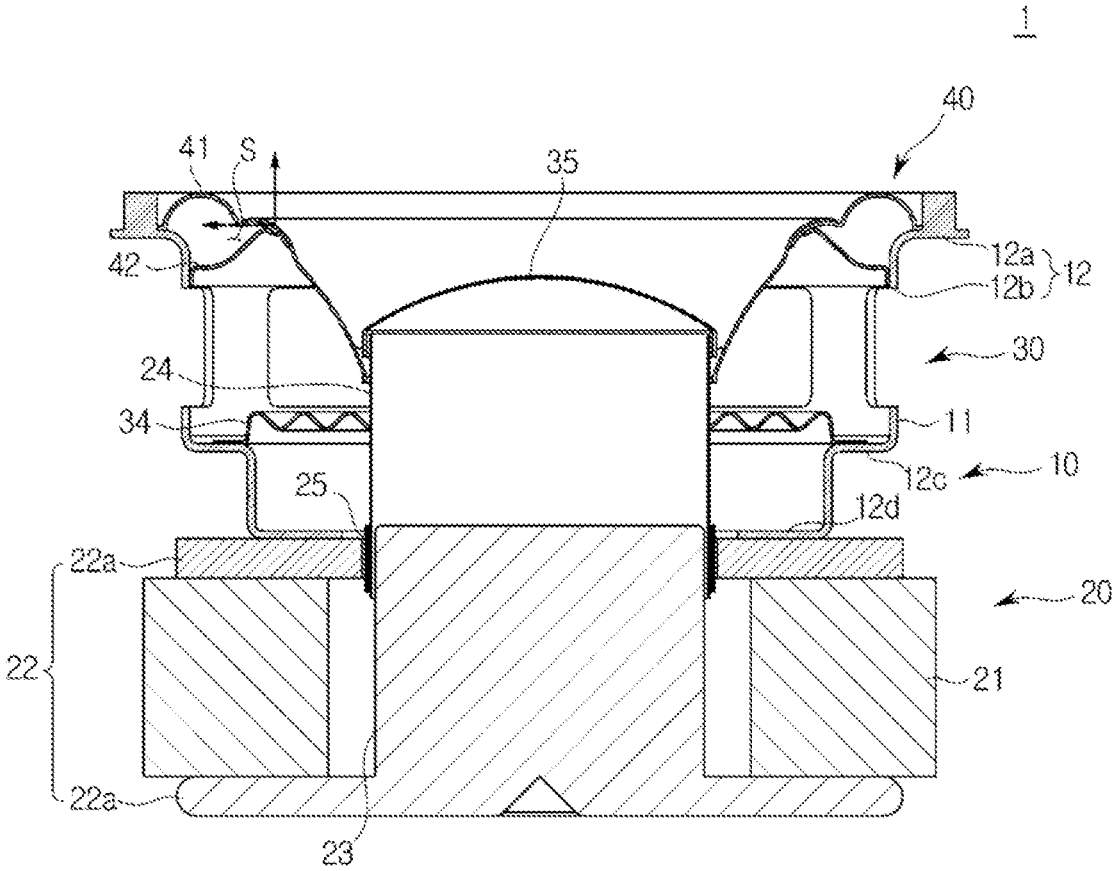
FIG. 5 is a schematic view illustrating an action of a force generated by the edge unit when an amplitude of a diaphragm of the speaker is directed upward according to an exemplary embodiment.
Figure 6:
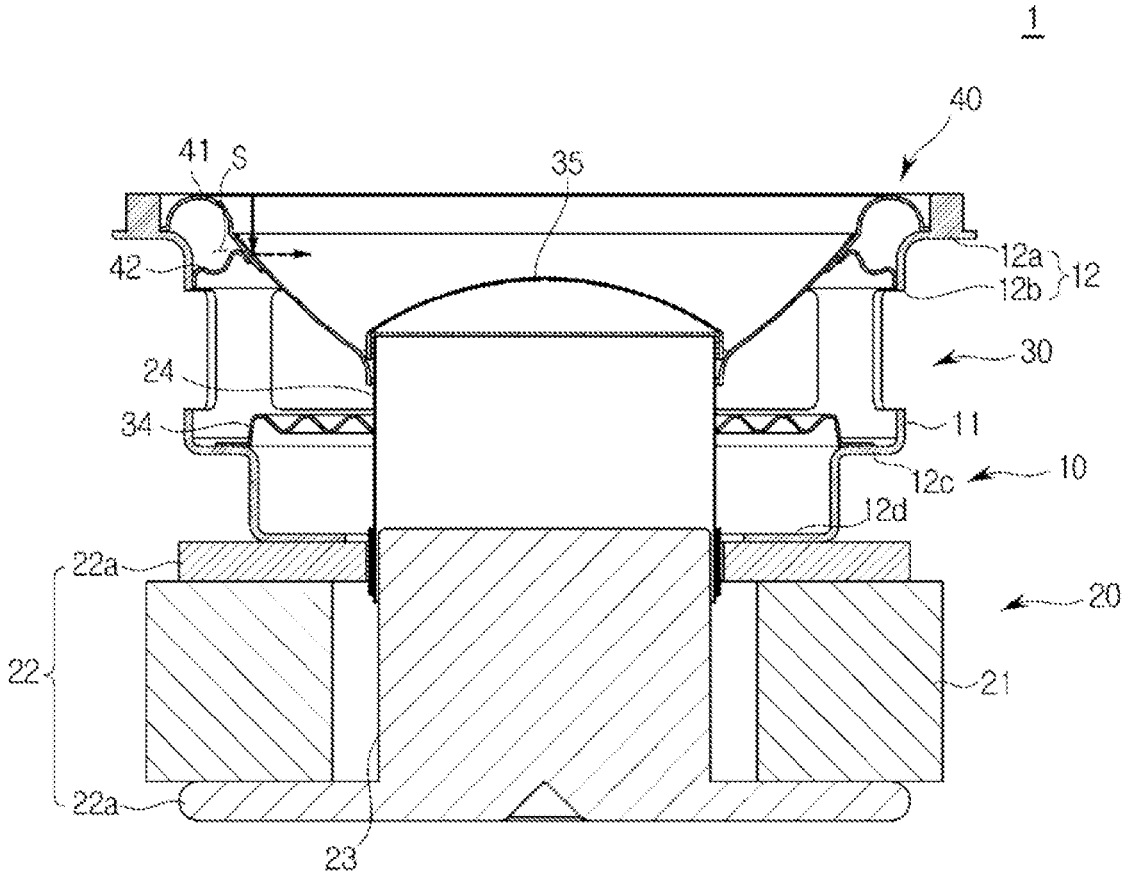
FIG. 6 is a schematic view illustrating an action of a force generated by the edge unit when the amplitude of the diaphragm of the speaker is directed downward according to an is directed upward embodiment.

FIG. 5 is a schematic view illustrating an action of a force generated by the edge unit when an amplitude of a diaphragm of the speaker is directed upward according to an exemplary embodiment. FIG. 6 is a schematic view illustrating an action of a force generated by the edge unit when the amplitude of the diaphragm of the speaker is directed downward according to an is directed upward embodiment.

As illustrated in FIGS. 5 and 6, the edge unit 40 of the speaker 1 according to the exemplary embodiment is disposed so that the first edge 41 and the second edge 42 may suppress dispersion of a force when the diaphragm 31 vibrates in the vertical direction and thus abnormal resonance can be prevented from occurring.

When external power is supplied to the voice coil 25 and the voice coil 25 vibrates in the vertical direction due to an electromagnetic force generated between the voice coil 25 and the magnetic circuit unit 20, the diaphragm 31 vibrates in the corresponding vertical direction due to the voice coil 25.

When the diaphragm 31 of the speaker 1 moves upward, i.e., when an amplitude of the diaphragm 31 is directed upward $F_a$ (an solid line arrow pointing upward of FIG. 5 as an action force), a force $F_r$ of an inclined surface portion acts to the outside (a dotted line arrow as a reaction force) due to the second edge 42 connected to a lower portion of the diaphragm 31 so that division resonance of the diaphragm 31 can be suppressed.

Also, when the diaphragm 31 moves downward, i.e., when the amplitude of the diaphragm 31 is directed downward $F_a$ (a solid line arrow pointing downward of FIG. 6 as an action force), the force $F_r$ of the inclined surface portion acts to toward the center of the speaker 1 (a dotted line arrow as a reaction force) due to the first edge 41 and the second edge 42 so that division resonance of the diaphragm 31 can be suppressed.

Thus, the first edge 41 and the second edge 42 according to the exemplary embodiment is attached to the diaphragm 31 of the speaker 1 so that division resonance of the diaphragm 31 and a connection portion of the diaphragm 31 and the first edge 41 can be suppressed and sound quality thereof can be improved.

Figure 7:
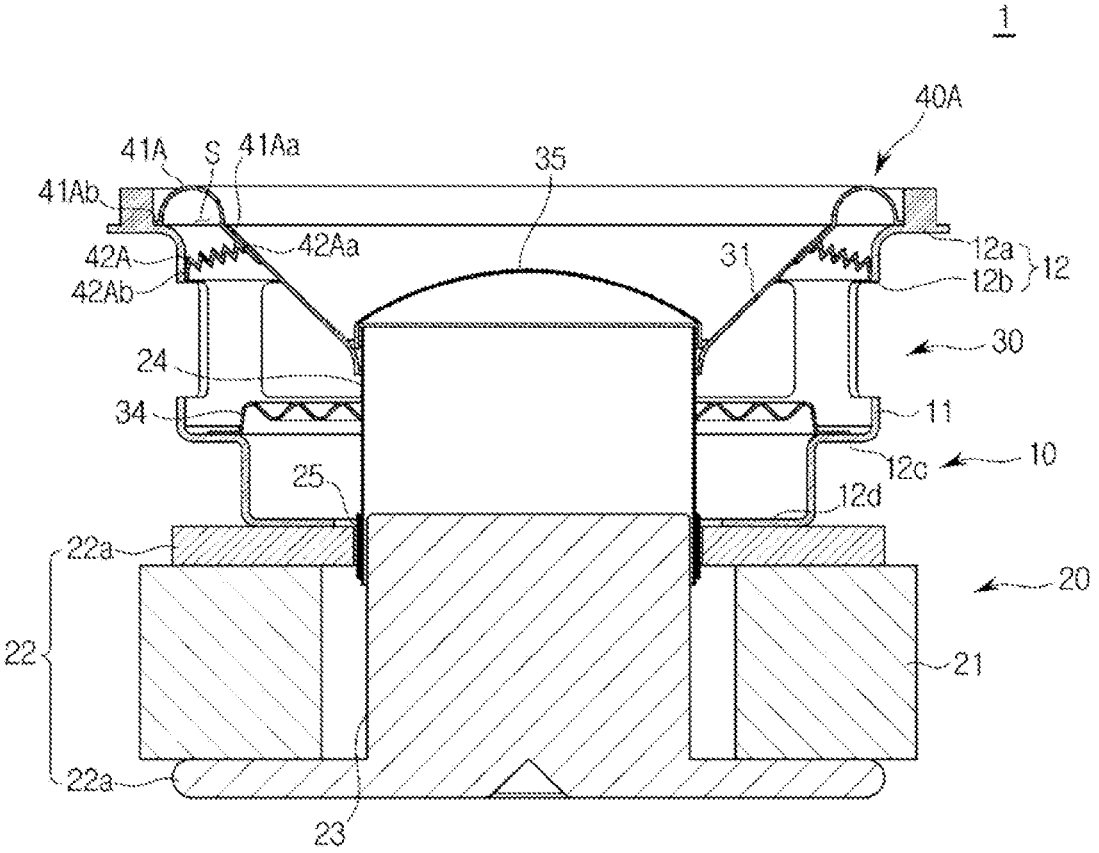
FIG. 7 is a view of an edge unit of a speaker according to an exemplary embodiment.
Figure 8:
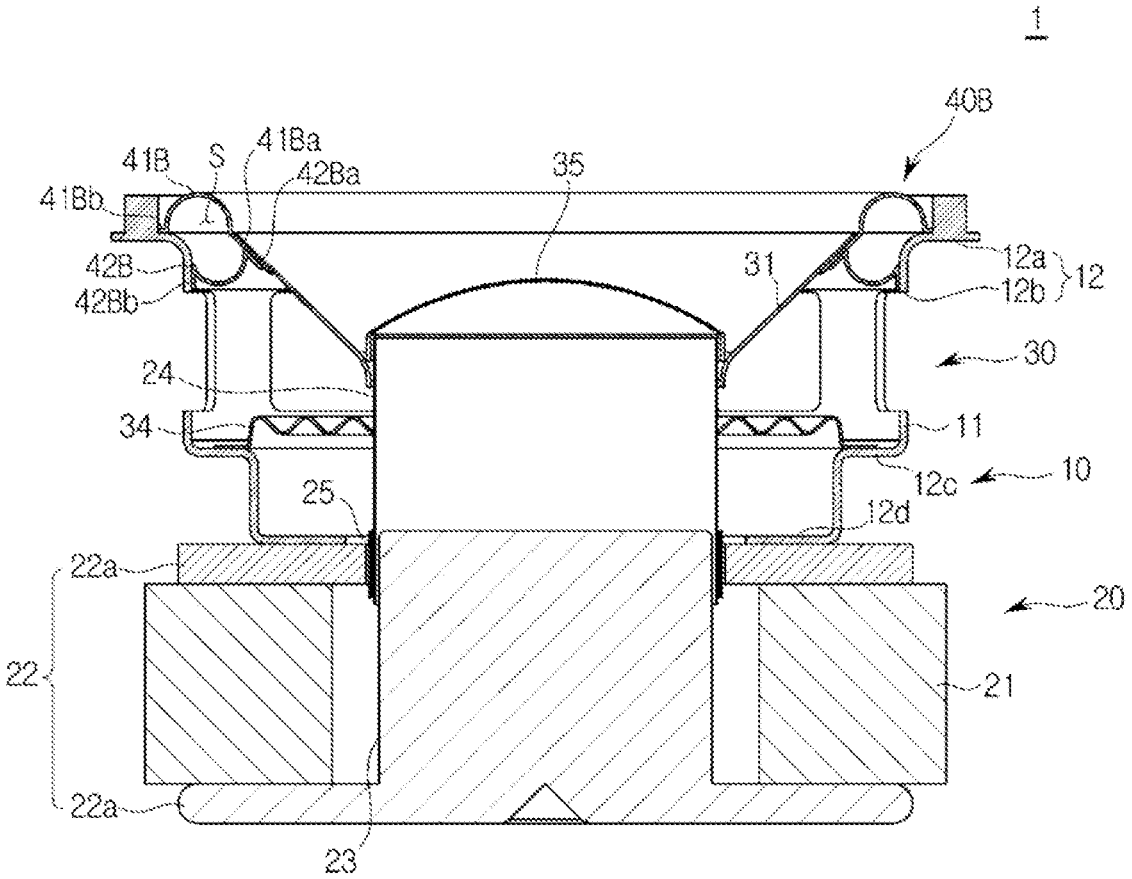
FIG. 8 is a view of an edge unit of a speaker according to still an exemplary embodiment.

FIG. 7 is a view of an edge unit of a speaker according to an exemplary embodiment. FIG. 8 is a view of an edge unit of a speaker according to still an exemplary embodiment.

As illustrated in FIGS. 7 and 8, an edge unit 40A according to another exemplary embodiment includes a first edge 41A and a second edge 42A disposed to suppress division resonance of the diaphragm 31.

In the exemplary embodiment, the first edge 41A may include a first contact surface 41Aa, a second contact surface 41Ab, and a bending surface 41Ac formed between the first contact surface 41Aa and the second contact surface 41Ab.

The first edge 41A is disposed to connect the diaphragm 31 and the frame 10 through the first contact surface 41Aa and the second contact surface 41Ab.

A cross-section of the bending surface 41Ac that connects the first contact surface 41Aa and the second contact surface 41Ab may include at least one among a hemispherical shape, a triangular shape, a rectangular shape, and a wave shape.

The second edge 42A is disposed outside a lower portion than the first edge 41A so as to connect the diaphragm 31 and the frame 10. In the exemplary embodiment, the second edge 42A may include a diaphragm connection portion 42Aa formed in an inner circumference of the second edge 42A so as to come into contact with the outside of the diaphragm 31 and a frame connection portion 42Ab formed in an outer circumference of the second edge 42A so as to come into contact with the outside of the frame 10.

The second edge 42A may be formed so that a cross-section of the second edge 42A has a wrinkle shape and thus may elastically control vertical vibration of the diaphragm 31.

An operation of controlling vibration of the diaphragm 31 of the vibration unit 30 of the speaker 1 to which the first edge 41A and the second edge 42A disposed in rear of the first edge 41A are applied, is the same as above and thus, a detailed description thereof will be omitted.

Also, an edge unit 40B according to yet another exemplary embodiment includes a first edge 41B disposed to suppress division resonance of the diaphragm 31 and a second edge 42B disposed at a lower side of the first edge 41B.

In this case, the first edge 41B may include a first contact surface 41Ba, a second contact surface 41Bb, and a bending surface 41Bc formed between the first contact surface 41Ba and the second contact surface 41Bb.

The first edge 41B is disposed to connect the diaphragm 31 and the frame 10 through the first contact surface 41Ba and the second contact surface 41Bb. The first edge 41B may further include the bending surface 41Bc that connects the first contact surface 41Ba and the second contact surface 41Bb.

The second edge 42B is disposed at a lower side than the first edge 41B so as to connect the diaphragm 31 and the frame 10. In this case, the second edge 42B may include a diaphragm connection portion 42Ba formed in an inner circumference of the second edge 42B so as to come into contact with the outside of the diaphragm 31 and a frame connection portion 42Bb formed in an outer circumference of the second edge 42B so as to come into contact with the outside of the frame 10.

The second edge 42B may be formed to have a hemispherical shape in which a cross-section of the second edge 42B protrudes downward. The second edge 42B may include one of the hemispherical shape, the triangular shape, and the rectangular shape.

An operation of controlling vibration of the diaphragm 31 of the speaker 1 to which the first edge 41B and the second edge 42B disposed in rear of the first edge 41B are applied, is the same as above, and thus a detailed description thereof will be omitted.

Thus, edges having various shapes can be applied to the case where the speaker 1 is designed, so that improvements in performance of a speaker and design efficiency can be achieved.

As described above, according to the exemplary embodiments, division vibration of a diaphragm can be suppressed so that linearity can be secured.

In addition, an undesired increase in a distortion factor and distortion of the diaphragm do not occur so that sound quality characteristics can be improved.

Furthermore, edges having various shapes can be applied so that improvements in performance of a speaker and design efficiency can be achieved.

While exemplary embodiments have been particularly shown and described above, it would be appreciated by those skilled in the art that various changes may be made therein without departing from the principles and spirit of the inventive concept defined in the following claims.

What is claimed is:

1. A speaker comprising:

a frame;

a magnetic circuit unit coupled to the frame and configured to generate a magnetic force;

a voice coil provided in the frame and configured to vibrate according to the magnetic force;

a diaphragm configured to vibrate and produce sound in response to vibration of the voice coil; and an edge unit that connects the diaphragm and the frame, wherein the edge unit comprises:

a first edge provided between the diaphragm and the frame and configured to control vibration of the diaphragm; and a second edge provided under the first edge in an axial direction of the speaker, and wherein the first edge comprises a first contact surface that contacts the diaphragm and is provided under the diaphragm.

2. The speaker of claim 1, wherein the first edge further comprises:

a second contact surface connected to the frame; and a bending surface provided between the first contact surface and the second contact surface.

3. The speaker of claim 2, wherein the bending surface comprises at least one bend that elastically connects the diaphragm and the frame.

4. The speaker of claim 2, wherein the second edge comprises:

a diaphragm connection portion connected to the diaphragm;

a frame connection portion connected to the frame; and a bending portion provided between the first contact surface and the second contact surface.

5. The speaker of claim 4, wherein the diaphragm connection portion of the second edge is connected to the first contact surface of the first edge.

6. The speaker of claim 5, wherein an inner circumference portion of the second edge is provided closer to the magnetic circuit unit than an outer circumference portion of the second edge.

7. The speaker of claim 1, wherein a separation space is provided between the first edge and the second edge.

8. The speaker of claim 1 further comprising a damper configured to adjust a vibration direction of the diaphragm, wherein the second edge is disposed between the first edge and the damper in the axial direction.

9. The speaker of claim 8, wherein the damper is provided under the diaphragm in the axial direction.

10. The speaker of claim 1, wherein a cross-section of the second edge comprises at least one among a circular shape, a triangular shape, a rectangular shape, a plate shape, and a wave shape.

11. The speaker of claim 1, wherein a cross-section of the first edge comprises at least one among a circular shape, a triangular shape, a rectangular shape, a plate shape, and a wave shape.

12. The speaker of claim 1, wherein the first contact surface of the first edge is provided between the diaphragm and a diaphragm connection portion of the second edge contacting the diaphragm.

13. A speaker comprising:

a frame;

a diaphragm; and an edge unit that connects the frame and the diaphragm, wherein the edge unit comprises:

a first edge that connects an upper portion of the diaphragm and an upper portion of the frame; and a second edge that is spaced apart from the first edge in a downward axial direction of the speaker and connects an outer circumferential surface of the diaphragm and an inner circumferential surface of the frame, and wherein the first edge comprises a first contact surface that contacts the diaphragm and is provided in the downward axial direction from the diaphragm.

14. The speaker of claim 13, wherein the frame comprises:

a first flange provided at a top end portion of the frame and connected to outer edges of the first edge; and a second flange spaced apart from the first flange in the downward axial direction and connected to outer edges of the second edge.

15. The speaker of claim 14, wherein a diameter of the first flange is different from a diameter of the second flange.

16. The speaker of claim 14, wherein a height of the first flange is different from a height of the second flange.

17. The speaker of claim 13, wherein the first edge further comprises:

a second contact surface connected to the frame; and a bending surface provided between the first contact surface and the second contact surface.

18. The speaker of claim 17, wherein the bending surface comprises at least one bend that elastically connects the diaphragm and the frame.

19. The speaker of claim 13, wherein the second edge comprises:

a diaphragm connection portion connected to the diaphragm;

a frame connection portion connected to the frame; and a bending portion provided between the first contact surface and the second contact surface.

20. The speaker of claim 19, wherein the diaphragm connection portion of the second edge is connected to the first contact surface of the first edge.

21. The speaker of claim 20, wherein the diaphragm connection portion is provided at an upward axial direction from the frame connection portion.

22. The speaker of claim 13, wherein the first contact surface of the first edge is provided between the diaphragm and a diaphragm connection portion of the second edge contacting the diaphragm.

23. A speaker comprising:

a frame;

a magnetic circuit unit coupled to the frame and configured to generate a magnetic force;

a voice coil disposed in the frame and configured to vibrate due to the magnetic force;

a diaphragm configured to vibrate and generate sound due to the vibration of the voice coil; and an edge unit that connects the diaphragm and the frame, wherein the edge unit comprises:

a first edge comprising:

a first contact surface connected to the diaphragm;

a second contact surface connected to the frame; and a bending surface that connects the first contact surface and the second contact surface; and a second edge comprising:

a diaphragm connection portion connected to the diaphragm;

a frame connection portion connected to the frame; and a bending portion that connects the diaphragm connection portion and the frame connection portion, and wherein the frame connection portion of the second edge is disposed to be spaced apart from the second contact surface of the first edge, and wherein the first contact surface of the first edge is stacked between the diaphragm and the diaphragm connection portion of the second edge.

24. The speaker of claim 23, wherein the frame comprises:

a first flange connected to the second contact surface; and a second flange spaced apart from the first flange in a downward axial direction and connected to the frame connection portion.

25. The speaker of claim 24, wherein a diameter of the first flange is different from a diameter of the second flange.

26. The speaker of claim 23, wherein the bending surface comprises at least one bend that elastically connects the diaphragm and the frame.

27. The speaker of claim 23, wherein the diaphragm connection portion of the second edge is configured to come into contact with the first contact surface.

28. The speaker of claim 23, wherein the diaphragm connection portion is provided at an upward axial direction from the frame connection portion.

29. A speaker comprising:

a frame;

a magnetic circuit unit coupled to a bottom portion of the frame and configured to generate a magnetic force;

a voice coil provided in the frame and configured to vibrate according to the magnetic force;

a diaphragm provided inside the frame at a top portion opposite to the bottom portion in an axial direction and configured to produce sound; and an edge unit that attaches the diaphragm and the frame to each other, wherein the edge unit comprises:

a first edge that connects a first portion of the diaphragm and a first portion of the frame; and a second edge that connects a second portion of the diaphragm and a second portion of the frame, wherein the second portion of the frame is provided at a portion lower than the first portion of the frame, and wherein the first edge comprises a first contact surface that is connected to the diaphragm and is stacked between the first portion of the diaphragm and the second edge.

30. The speaker of claim 29, wherein the first edge comprises:

a first contact surface connected to the diaphragm;

a second contact surface connected to the frame; and a bending surface provided between the first contact surface and the second contact surface.

31. The speaker of claim 29, wherein the second edge comprises:

a diaphragm connection portion connected to the diaphragm;

a frame connection portion connected to the frame; and a bending portion provided between the first contact surface and the second contact surface.

32. The speaker of claim 29 further comprising a damper configured to adjust a vibration direction of the diaphragm, wherein the second edge is disposed between the first edge and the damper in the axial direction.

* * * * *